United States Patent [19]

Ushiku et al.

[11] Patent Number: 4,925,378

[45] Date of Patent: May 15, 1990

[54] ROTARY VANE COMPRESSOR WITH VALVE CONTROLLED PRESSURE BIASED SEALING MEANS

[75] Inventors: Kenichi Ushiku, Ibaraki; Akira Tezuka, Katsuta, both of Japan

[73] Assignee: Hitachi, Ltd., Tokyo, Japan

[21] Appl. No.: 271,891

[22] Filed: Nov. 16, 1988

[30] Foreign Application Priority Data

Nov. 16, 1987 [JP] Japan ..... 62-287320
Dec. 21, 1987 [JP] Japan ..... 62-321290

[51] Int. Cl.[5] ..... F04C 18/344; F04C 27/00
[52] U.S. Cl. ..... 418/148; 418/255
[58] Field of Search ..... 418/148, 254, 255

[56] References Cited

U.S. PATENT DOCUMENTS 552,854 1/1896 Morse ..... 418/255
1,032,342 7/1912 Morell ..... 418/254
1,390,744 9/1921 Ambrose .
1,637,484 8/1927 Hapgood .
2,413,935 1/1947 Williams .
2,876,706 3/1959 Baus ..... 418/148
3,945,775 3/1976 Louzecky .

FOREIGN PATENT DOCUMENTS 53-106914 9/1978 Japan .
61-201896 9/1986 Japan .

*Primary Examiner*—John J. Vrablik
*Attorney, Agent, or Firm*—Antonelli, Terry & Wands

[57] ABSTRACT

A rotary vane compressor comprising a cylinder, a rotor rotatably mounted within the cylinder and cooperating with an inner peripheral surface of the cylinder to define a compression chamber therebetween, two side plates for closing both ends of the cylinder, at least one vane slidably mounted to the rotor for movement radially toward and away from the rotor through an outer peripheral surface thereof and dividing the compression chamber into a plurality of spaces, and a chip seal provided on a forward end of the vane for slidably engaging with the inner peripheral surface of the cylinder. The sealing efficiency of the chip seal is increased by introducing the pressure in a central portion of the rotor into the forward end of the vane.

9 Claims, 6 Drawing Sheets

4
3
R
P
Q
5
15
16
19
K

K
19
15
26
4
3
R
P
Q
17
19d
5
25
16
8a
24
30
8b
15
19c
31
23
25
16

ROTARY VANE COMPRESSOR WITH VALVE CONTROLLED PRESSURE BIASED SEALING MEANS

BACKGROUND OF THE INVENTION

The present invention relates to a rotary compressor, and more particularly, to a vane-type rotary compressor adapted to be used as an air conditioning compressor of a vehicle.

In general, a rotary vane compressor comprises a cylinder, a rotor rotatably mounted within the cylinder and cooperating with an inner peripheral surface of the cylinder to form a compression chamber therebetween, two side plates for closing both ends of the cylinder, and at least one vane slidably mounted to the rotor for reciprocating movement toward and away from the rotor and dividing the compression chamber into a plurality of compression spaces.

In a conventional rotary vane compressor of the above-mentioned type, as disclosed in, for example, Japanese Patent Unexamined Publication Nos. 61-201896 and 53-106914, the vane is provided at its ends with sub-vanes slidably mounted thereon, and the volume of the compression chamber formed between the outer peripheral surface of the rotor and the inner peripheral surface of the cylinder is increased or decreased as the vane and sub-vanes are rotated along with the rotor, thereby feeding or discharging the pressurized fluid. Further, in this conventional rotary vane compressor, blow-by gas is introduced from the compression chamber to a space in a central portion of the rotor to flow the blow-by gas through the clearances formed between the vanes and the rotor, thereby lubricating the slidingly contacting surfaces of the vanes and rotor. Further, in order to prevent the back flow of the fluid from leaking from between the ends of the vane and the inner peripheral surface of the cylinder, the pressure was applied to the backs of the vane and sub-vanes. Particularly, with respect to the sub-vanes, on the basis of the fact that higher pressure in a higher pressure space between two compression spaces adjacent to the vane and sub-vanes flows into a lower pressure space through the clearances formed between the vane and the sub-vanes, a part of said higher pressure flowed into said lower pressure space was introduced into the back of the sub-vanes, thereby providing sealing pressure.

However, in this conventional rotary vane compressor, when the vanes are in a compression stroke the pressure acting on the back of the sub-vanes is sufficiently high, but, when the vanes are in a suction stroke such pressure is relatively low. Consequently, in the suction stroke, the pressure sufficient to provide the proper sealing pressure for the sub-vanes cannot be obtained, which occurs a problem when the rotor is rotated at a low speed in that the efficiency of the seal between the sub-vanes and the inner peripheral surface of the cylinder is reduced, thus increasing loss of leakage of the fluid.

U.S. Pat. No. 3,945,775 discloses a construction that the sub-vanes themselves are pressed against the inner surface of the cylinder.

However, according to such construction, since the sub-vanes are always subjected to the pressure due to a spring force, a strong spring is necessary to provide the constant higher pressure, and there is a larger mechanical loss.

Further, since the pressure is obtained from the spring, the number of parts inevitably increase, and, therefore, reliability of operation of the compressor is decreased.

SUMMARY OF THE INVENTION

An object of the present invention is to provide a rotary vane compressor which can maintain a proper sealing pressure for sealing members sealingly slidable on an inner peripheral surface of a cylinder and can reduce leakage of fluid from the compressor.

Another object of the present invention is to provide a rotary compressor having movable vanes, which reduces friction loss and improves sealing feature on ends of the vanes, thereby increasing mechanical efficiency of the compressor.

The above and other objects of the present invention can be achieved by providing a rotary vane compressor comprising communication means for introducing pressure from an central portion of a rotor into ends of vanes, and valve means for controlling opening and closing of the communication means in response to movement of a slider slidably mounted between the vanes.

DESCRIPTION OF THE PREFERRED EMBODIMENTS

The present invention will now be explained with reference to the attached drawings. In embodiments illustrated below, the present invention is applied to a rotary vane compressor described in the aforementioned Japanese Patent Unexamined Publication No. 61-201896. However, it should be noted that the present invention is not limited to such rotary vane compressor.

Figure 1:
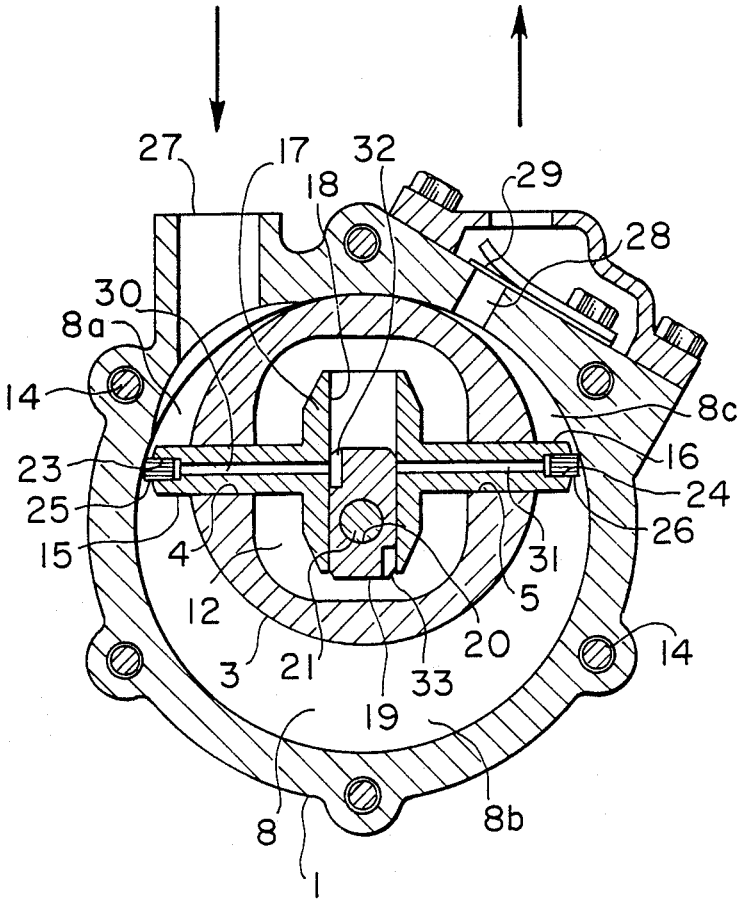
FIG. 1 is a cross-sectional view of a rotary vane compressor according to a preferred embodiment of the present invention, which is taken along the line I—I of FIG. 2.
Figure 2:
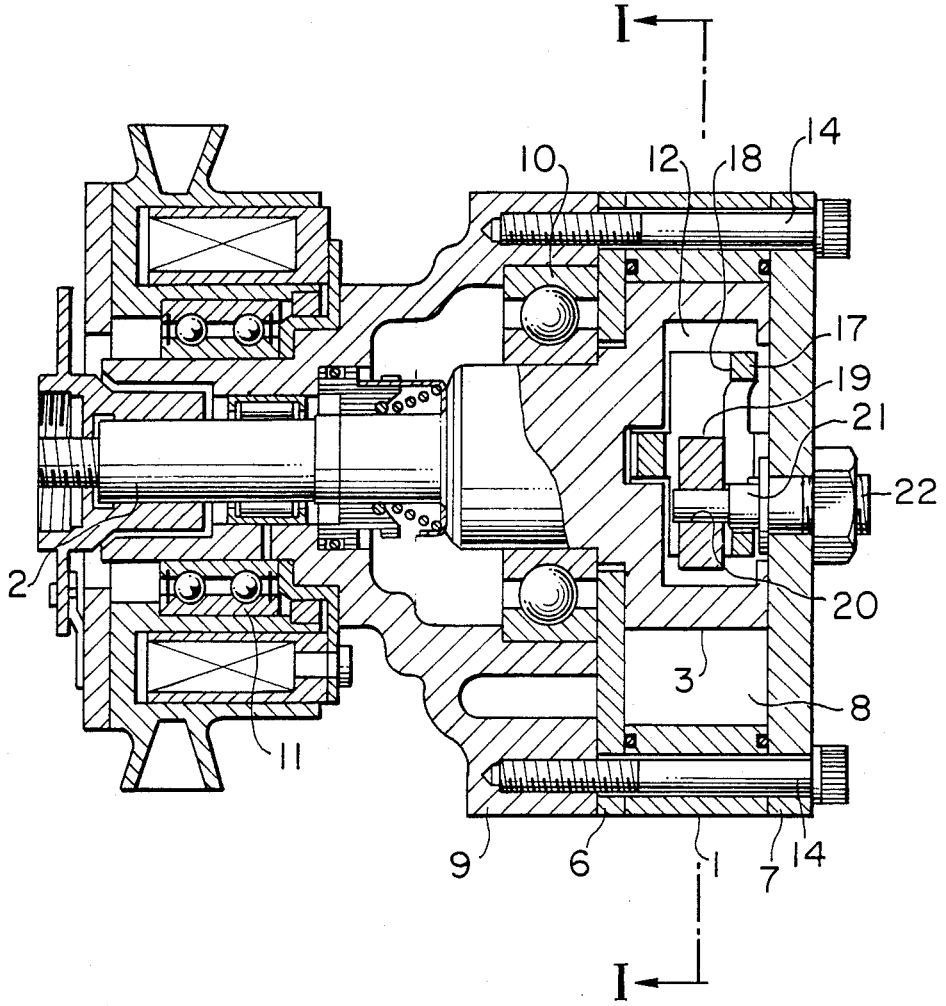
FIG. 2 is a side sectional view of the rotary compressor of FIG. 1.

A rotary vane compressor according to a first embodiment shown in FIGS. 1 and 2 comprises a generally cylindrical cylinder 1 having a particular cylindrical inner surface, with a rotor 3, formed integrally with a shaft 2, being rotatably mounted in the cylinder 1, and a pair of vane grooves 4 and 5 being formed in the rotor 3 in a diametrically opposed relation. The shaft 2 extends from only one side of the rotor 3, and a large central cavity 12 is formed in the rotor 3 and is opened to the other side of the rotor 3. Both ends of the cylinder 1 are closed by two side plates, i.e., a front side plate 6 and a rear side plate 7 so that a compression chamber 8 is defined between an inner peripheral surface of the cylinder 1, an outer peripheral surface of the rotor 3 and the side plates 6, 7. The shaft 2 of the rotor 3 is rotatably supported by two bearings 10 and 11 arranged in a front cover 9 so that the rotor 3 is rotatably supported in cantilever fashion.

The front cover 9, side plate 6, cylinder 1 and side plate 7 are axially overlapped in order and are integrally clamped altogether by a plurality of bolts 14 passing through peripheral portions of these elements. A suction port 27 and a discharge port 28 having a delivery valve 29 are formed in the cylinder 1.

A pair of interconnected vanes 15 and 16 are slidably mounted on the rotor 3 in such a manner that the vanes 15, 16 can be rotated along with the rotor 3 and can be shifted in the corresponding vane grooves 4 and 5 in a radial direction toward and away from the rotor 3. The compression chamber 8 is divided into three compression spaces 8*a*, 8*b* and 8*c* by the vanes 15 and 16. The paired vanes 15 and 16 are integrally interconnected by an intermediate central guide member 17 which is provided with a cylindrical slide groove 18 extending in a direction orthogonal to sliding faces of the vanes 15 and 16. A slider 19 is slidably mounted in the slide groove 18 for movement in an axial direction of the groove.

The slider 19 is provided at its central portion with a bearing hole 20 into which a slider pin 21, positioned in parallel with and eccentrically with respect to an axis of the rotor 3, is received, so that the slider 19 is rotatably supported by the slider pin 21.

The slider pin 21 is fixed to the rear side plate 7 by a nut 22 at a side opposite to the side where the rotor 3 is supported, i.e., the side where the shaft 2 is arranged. Consequently, the slider pin 21 protrudes from the rear side plate 7 toward the rotor 3 and is supported by the rear side plate 7 in cantilever fashion.

Seal recesses 23 and 24 are formed at forward ends of the corresponding vanes 15 and 16, into which corresponding sealing members i.e., chip seals 25 and 26 are assembled. The chip seals 25, 26 slidably engage with the inner peripheral surface of the cylinder 1 for sealing a small gap between the vanes 15, 16 and the inner peripheral surface of the cylinder 1.

Figures 3A, 3B, 3C, 3D, 3E, 3F:
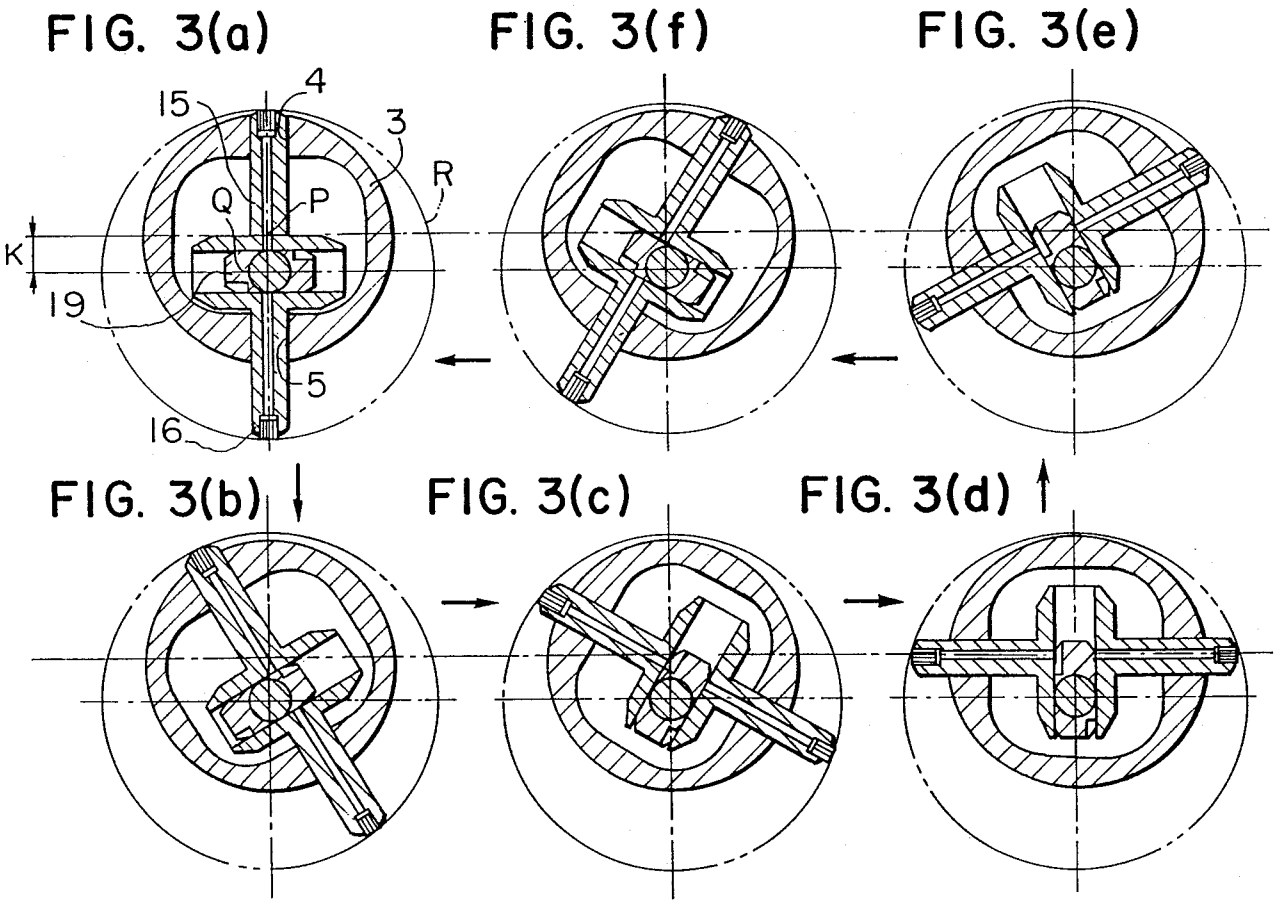
FIGS. 3*a*–3*f* are schematic cross-sectional views of the compressor for explaining the operation of the compressor.

With the construction mentioned above, the rotary vane compressor can operate in the manner shown in FIG. 3. More particularly, when the shaft 2 of the rotor 3 rotates around its own axis P, the vanes 15 and 16 mounted in the vane grooves 4 and 5 are rotated along with the rotor; however, since the vanes 15 and 16 are also restrained by the slider 19 turned around an axis Q of the slider pin 21, a vertical bisector bisecting the vanes 15, 16 always pass through the point Q. Consequently, as shown by the positional sequence of FIG. 3(*a*), 3(*b*), 3(*c*), 3(*d*), 3(*e*), and 3(*f*), the vanes 15 and 16 can perform a forward stroke (one way) of the reciprocal movement during a half of a rotation of the rotor 3. Similarly, the vanes 15, 16 can shift in the corresponding vane grooves 4, 5 by a backward stroke during the other half of rotation of the rotor 3. Accordingly, the vanes 15 and 16 perform one complete reciprocal movement during one rotation of the rotor 3. In this case, a locus R described or followed by the forward end of each vane 15, 16 is not a true or complete circle, but a special curve. However, since the inner peripheral surface of the cylinder 1 is machined to have a special concave surface complementary to the locus R, when the rotor 3 is rotated within the cylinder 1, the volumes of the compression spaces 8*a*, 8*b* and 8*c* are repeatedly increased or decreased by the rotor 3, cylinder 1, vanes 15, 16 and side plates 6, 7, thereby acting as a displacement compressor.

Figure 4:
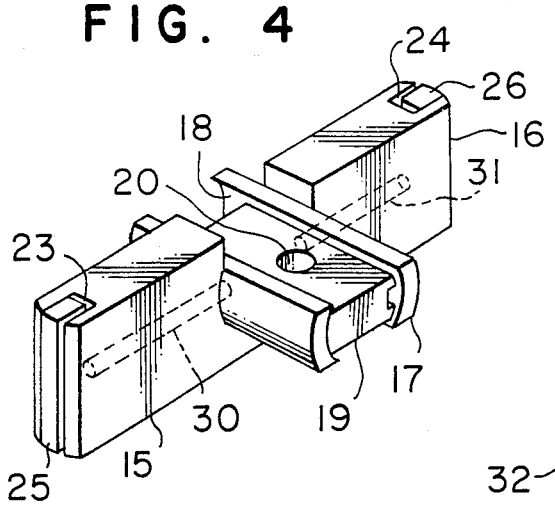
FIG. 4 is a perspective view ;showing vanes and a slider of the rotary compressor of FIG. 1.
Figure 5:
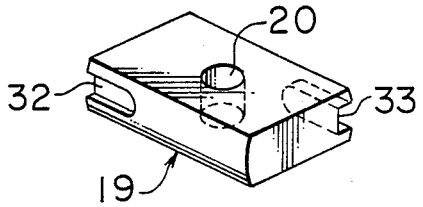
FIG. 5 is a perspective view of the slider of FIG. 4 in which a part of a guide member is omitted.

As shown in FIGS. 1 and 4, the vanes further include communication passages 30 and 31, respectively, these communication passages 30, 31 each having a diameter of h and openings opened at the slide groove 18 and seal grooves 23, 24, respectively. Further, as shown in FIGS. 1 and 5, two elongated recesses 32 and 33 are formed in the sliding surfaces of the slider 19 at positions diagonally opposed to each other. These elongated recesses 32, 33 are opened at the end faces of the slider 19 and extend toward the center of the slider 19, and constitute valve means for controlling the opening and closing of the communication passages 30 and 31 in response to the movement of the slider 19.

Figure 6A:
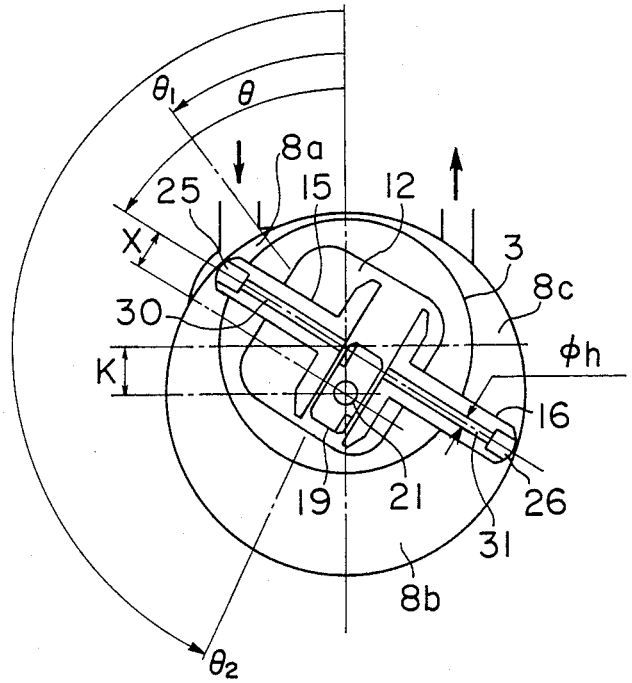
FIG. 6A is a schematic view illustrating a relationship between a rotational angle of a rotor, a distance between a center of a slider pin and a center line of communication passages, and pressure in the compressor.
Figure 6B:
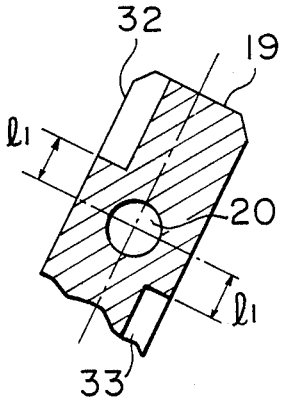
FIG. 6B is a cross-sectional detail view of a portion of the slider of FIG. 4.
Figure 7:
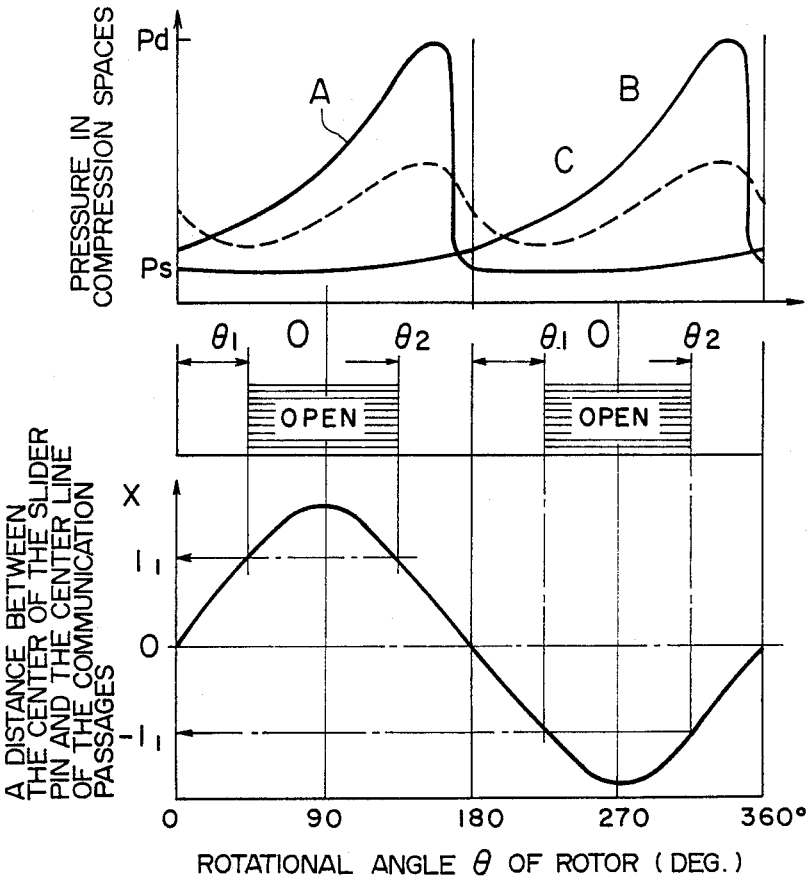
FIG. 7 is a graphical illustration of the relationship of FIG. 6A.

The length of each of the elongated recesses 32 and 33 is so selected that the communication passages 30 and 31 are opened in an angular range between an rotational angle $\theta$ of the vanes 15, 16 which corresponds to an initial portion of the suction stroke and a rotational angle $\theta_2$ ($\theta 2 = 180° - \theta_1$, thus $\theta_2$ is determined by $\theta_1$; refer to FIGS. 6 and 7). More particularly, in consideration of a scotch yoke mechanism having an offset value K between the center of rotation of the rotor 3 and the center of the slider pin 21 (center of the bearing hole 20), when it is assumed that the distance between the center of the slider pin 21 and the center line of the communication passage 30 or 31 is x, the distance x is defined by an equation $x = K \cdot \sin\theta$. Consequently, when the distance between the center of the slider 19 (center of the slider pin 21) and each elongated recess 32, 33 is designated by , the distance , is defined by the following equation:

$$_1 = k \cdot \sin\theta_1 - h/2.$$

Next, the operation of the compressor according to the illustrated embodiment will now be explained with reference to FIGS. 6 and 7.

First of all, while the rotor 3 is rotated by one revolution as explained in connection with FIG. 3(*a*)-3(*f*), for example, the pressure in the compression space 8*b* formed or defined forwardly of the vane 15 with respect to the rotational direction of the rotor 3 changes from suction pressure Ps to discharge pressure Pd in response to the rotational angle 8, as shown by a solid line A in FIG. 7; whereas the pressure in the compression space 8*a* formed rearwardly of the vane 15 changes from suction pressure Ps to discharge pressure Pd as shown by a solid line B in FIG. 7, which pressures Ps, Pd each have a phase lag of 180° with respect to that shown by the solid line A. Accordingly, the end portion of the vane 15 is subjected to pressure having different values. Thus, for example, when the angle of rotation is in the range of 0°-180°, the higher pressure in the compression space 8b flows into the lower pressure compression spaces 8a and 8c through the gaps or clearances between the seal recesses 23, 24 formed in the ends of the vanes 15, 16 and the chip seals 25, 26 received in the seal recesses. In this case, the higher pressure flowing through said gaps acts on the back of the chip seals 25 and 26, thus providing the sealing pressure for pressing the chip seals 25, 26 against the inner peripheral surface of the cylinder 1.

On the other hand, in this case, the pressure in the compression spaces 8a, 8b and 8c is transmitted into the central cavity 12 of the rotor 3 as blow-by gas through the gaps between the seal recesses 23, 24 and the chip seals 25, 26 and gaps between the vane grooves 4, 5 and the vanes 15, 16 and the communication passages 30, 31 and the like, thus creating intermediate pressure (mixed by the higher pressure and the lower pressure) in the central cavity 12. This intermediate pressure is shown by a broken line C in FIG. 7.

In the illustrated embodiment, as explained above, the slider 19 includes the valve means constituted by the elongated recesses 32 and 33, and the lengths of the elongated recesses 32 and 33 are so selected that the communication passages 30 and 31 are opened in the angular range between the rotational angle $\theta_1$ of the vanes 15, 16 which corresponds to the initial stage of the suction stroke and the rotational angle $\theta_2$ which is defined by the equation $\theta_2 = 180° - \theta_1$. Consequently, in the suction stroke of the vane 15, the intermediate pressure in the central cavity 12 of the rotor 3 is applied to the back of the chip seals 25 and 26 through the communication passages 30 and 31, thus maintaining the proper sealing pressure which is not too large and not too small for the chip seals 25 and 26. Further, in a compression stroke of the vane, the communication passages 30 and 31 are closed, and the sealing pressure for the chip seals 25 and 26 is maintained by the above-mentioned pressure (from the compression space) passing through the gaps between the seal recesses 23, 24 formed in the vanes and the chip seals 25, 26. In this way, in all of the strokes of the vane while the rotor 3 is rotated by one revolution, the proper sealing pressure for the chip seals 25 and 26 can be always maintained.

Therefore, in the illustrated embodiment of the present invention, since the sealing pressure for the chip seals 25 and 26 in the suction stroke is an intermediate pressure which is not too high and not too low, the sealing feature or efficiency can be improved, thus reducing the leakage of the fluid as well as the mechanical loss due to the sliding movement of the chip seals 25, 26, thereby providing high efficiency rotary vane compressor.

Incidentally, although in the above illustrated embodiment, the present invention applied to the rotary vane compressor disclosed in the Japanese Patent Unexamined Publication No. 61-201896 was explained, the present invention is not limited to such compressor, but can be applied to any other rotary vane compressor, as long as the compressor comprises a cylinder, a rotor rotatably mounted within the cylinder and cooperating with an inner peripheral surface of the cylinder to define a compression chamber therebetween, two side plates for closing both ends of the cylinder, and at least one vane slidably mounted to the rotor for movement radially toward and away from the rotor through an outer peripheral surface thereof and dividing the compression chamber into a plurality of spaces.

Figure 8:
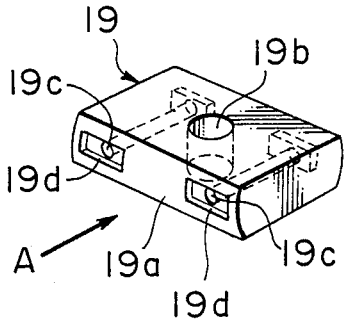
FIG. 8 is a perspective view of a slider according to another embodiment of the present invention.
Figure 9:
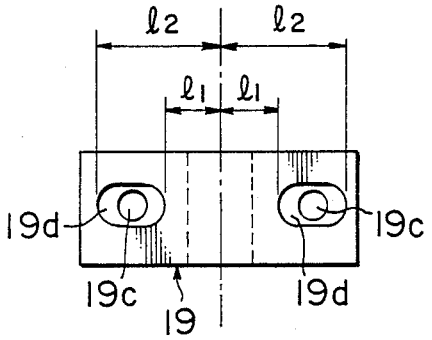
FIG. 9 is a elevational view of the slider viewed from an arrow A of FIG. 8, and FIGS. 10(*a*)–10(*f*) are schematic cross-sectional views of the compressor for explaining the operation of the embodiment of FIG. 8.
Figures 10A, 10B, 10C, 10D, 10E, 10F:
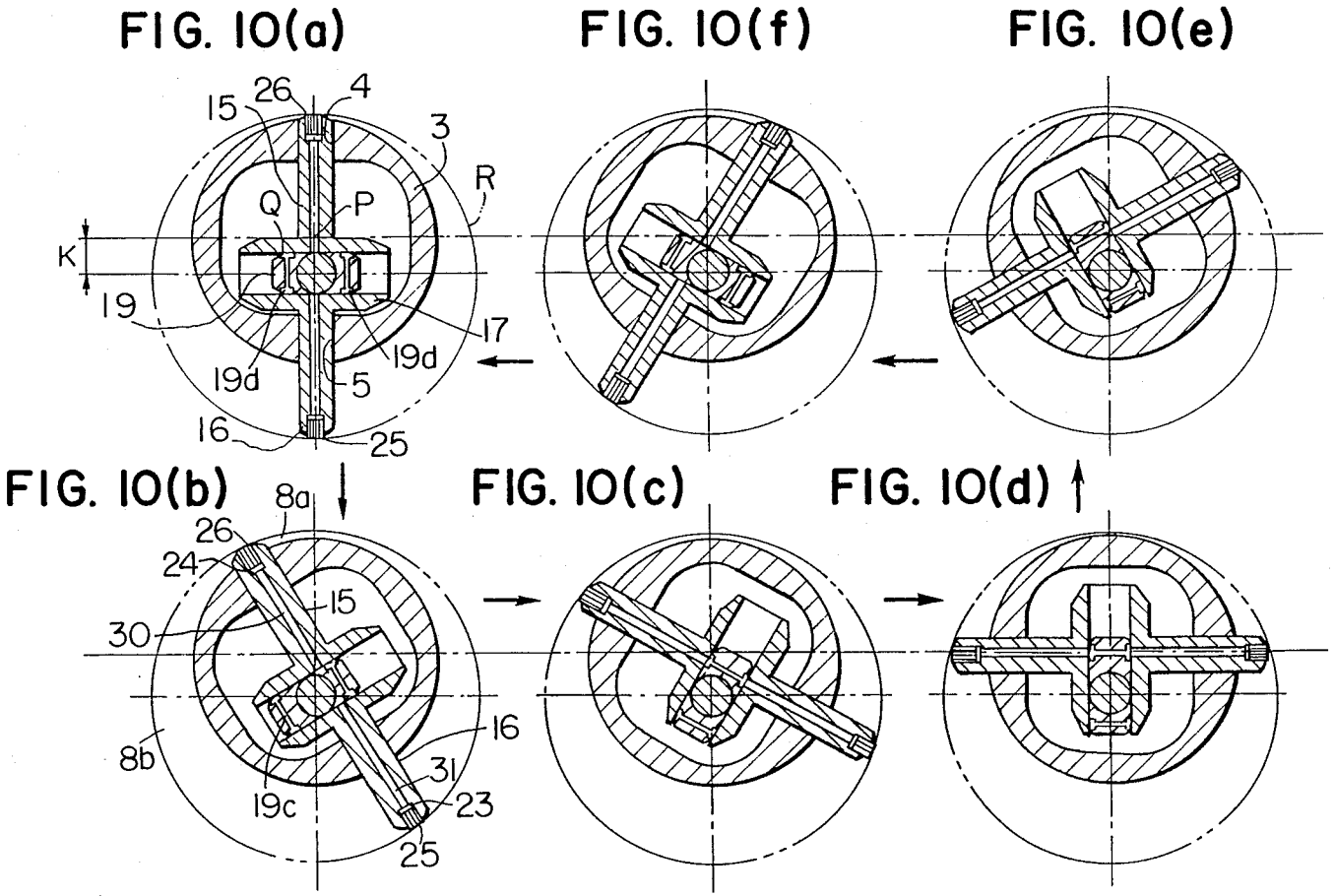

According to another embodiment of the present invention shown in FIGS. 8 and 9, a slider 19 is provided with valve means constituted by through holes 19c communicating with both of its sliding surfaces 19a and elongated recesses 19d positioned at the ends of the through holes, which can control the sealing pressure for the chip seals 25 and 26 by the communication and interruption between the communication passages in a range from any suction point to the vicinity of the discharge port. The communication and interruption are governed by dimensions $\theta_1$, $\theta_2$ of the elongated recesses 19d as shown in FIG. 9, which dimensions are reasonably determined by the offset value K between the center of the rotor 3 and the center of the slider pin 21, the communication commencing angle $\theta_1$ and the communication ceasing angle $\theta_2$ as shown in FIGS. 6 and 7.

Therefore, according to this embodiment, since the vanes 15, 16 can be non-contacted with the inner peripheral surface of the cylinder 1 and the sealing pressure for the chip seals 25, 26 can be controlled by the communications and interruption by means of the through holes 19c and elongated recesses 19d, it is possible to obtain a rotary vane compressor which can reduce the friction loss, has high mechanical efficiency and durability, and can reduce the leakage of the compressed gas by introducing the high pressure to the chip seals 25 and 26.

As shown in FIGS. 10(a)–10(f), the higher pressure in the compression space 8b formed forwardly of the vane 15 flows into the recess 23 formed on the forward end of the vane 16 through the gap between the recess 23 and the seal chip 25 acts on the back of the seal chip 25 thereby providing a sealing pressure for pressing the seal chip 25 against the inner peripheral surface of the cylinder 1. The higher pressure flowing in the recess 23 is introduced into the recess 24 formed on the forward end of the vane 15 in the suction stroke through the communication passage 31, through the hole 19c, and through the communication passage 30. The higher pressure introduced into the recess 24 acts on the back, of the seal chip 26 and provides the sealing pressure for pressing the seal chip 26 against the inner surface of the cylinder 1. Thus, in the embodiment of FIG. 8, the seal chip in the vane in the suction stroke is urged by higher pressure in the compression stroke, not by an intermediate pressure as with the first described embodiment.

As apparent from the above-mentioned explanation, according to the rotary vane compressor of the present invention, the proper sealing pressure for the chip seals slidably engaging with the inner peripheral surface of the cylinder can be maintained, the leakage loss can be reduced, and the compression efficiency can be improved.

What is claimed is:

1. A rotary vane compressor comprising:

a cylinder, a rotor rotatably mounted within the said cylinder and cooperating with an inner peripheral surface of said cylinder to define a compression chamber therebetween, two side plates means for respectively closing opposite ends of said cylinder, at least one pair of vanes slidably mounted on said rotor for movement radially toward and away from the rotor through an outer peripheral surface of the rotor and dividing said compression chamber into a plurality of compression spaces, said vanes being integrally interconnected and including a slide groove therebetween, a slider slidably received in said slide groove, sealing means provided on forward ends of said vanes for slidably engaging with the inner peripheral surface of said cylinder, communication means for introducing pressure in a central portion of said rotor, said pressure being applied to a rear portion of said sealing means, and valve means for controlling opening and closing of said communication means in response to movement of said slider.

2. A rotary vane compressor as set forth in claim 1, wherein said valve means includes two elongated recess means formed in sliding surfaces of said slider at positions diagonally opposed to each other and opening to the central portion of said rotor.

3. A movable vane type rotary compressor comprising:

casing means including a cylinder having a substantially cylindrical inner surface, side plate means for respectively closing opposite ends of said cylinder, a rotor rotatable within said cylinder, at least one pair of vanes rotatable along with said rotor and reciprocable radially of said rotor, said vanes being connected to each other, slider means slidable between said vanes, chip seal means provided at a forward end of said vanes, said chip seal means being slidably mounted in said vanes for engaging said cylindrical inner surface, and a communication passage provided in each of said vanes passing through in a radial direction thereof for balancing pressing forces acting on said chip seal means, wherein said communication passages can be communicated to each other by through holes formed in said slider means.

4. A movable vane type rotary compressor comprising:

casing means including a cylinder having a substantially cylindrical inner surface, side plate means for respectively closing opposite ends of said cylinder, a rotor rotatably mounted within said cylinder, at least one pair of interconnected vanes rotatable along with said rotor and reciprocable radially of said rotor, a slide groove means disposed between said vanes, slider means slidably received in said slide groove means, sealing means provided at a forward end of each of said vanes, communication means for introducing a pressure into said vanes to be applied against said sealing means so as to urge said sealing means against said substantially cylindrical inner surface of said cylinder, and means for controlling said communication means in response to movement of said slider means.

5. A movable vane-type rotary compressor as set forth in claim 4, wherein a slider pin means is provided for supporting said slider means in said rotor, and wherein said slider means is provided with through holes on both sides of said slider pin means.

6. A rotary vane compressor as set forth in claim 5, wherein elongated recess means are provided on both ends of each of said through holes.

7. A rotary vane compressor comprising:

a cylinder, a rotor rotatably mounted within said cylinder and cooperating with an inner peripheral surface of said cylinder to define a compression chamber therebetween, two side plates for respectively closing opposite ends of said cylinder, at least one pair of vanes slidably mounted on said rotor for movement radially toward and away form the rotor through an outer peripheral surface of the rotor and dividing said compression chamber into a plurality of compression spaces, said vanes being integrally connected and including a slide groove therebetween, a slider pin positioned in parallel with and eccentrically with respect to an axis of said rotor, a slider slidably received in said slide groove and rotatably supported by said slider pin, sealing means for slidably engaging with an inner peripheral surface of said cylinder provided on forward ends of said vanes, communication means for introducing pressure in a compression space in a compression stroke to a backside of said sealing means in a suction stroke of the compressor, and valve means for controlling an opening and closing of said communication means in response to movement of said slider.

8. A rotary vane compressor as set forth in claim 7, wherein said valve means comprises through holes intercommunicating with sliding surfaces of said slider provided on both sides of said slider pin.

9. A rotary vane compressor comprising:

a cylinder, a rotor rotatably mounted within said cylinder and cooperating with an inner peripheral surface of said cylinder to define a compression chamber therebetween, said rotor including a cavity formed therein, two side plates for respectively closing opposite ends of said cylinder, at least one pair of vanes slidably mounted on said rotor for movement radially toward and away from the rotor through an outer peripheral surface of the rotor and dividing said compression chamber into a plurality of compression spaces, said vanes being integrally connected and including a slide groove therebetween, a slider pin positioned in parallel with and eccentrically with respect to an axis of said rotor, a slider slidably received in said slide groove and rotatably supported by said slider pin, sealing means provided on forward ends of said vanes for slidably engaging with an inner peripheral surface of said cylinder, communication means for introducing pressure in said cavity of said rotor to a back of said sealing means, and valve means for controlling an opening and closing of said communication means in response to movement of said slider.

* * * * *

UNITED STATES PATENT AND TRADEMARK OFFICE

CERTIFICATE OF CORRECTION

PATENT NO. : 4,925,378

DATED : May 15, 1990

INVENTOR(S) : USHIKU, ET AL.

It is certified that error appears in the above-identified patent and that said Letters Patent is hereby corrected as shown below:

[75] Inventors: Kenichi Ushiku, Ibaraki; Akira Tezuka, Katsuta, Isao Hayase, Katsuta, all of Japan

Signed and Sealed this

Ninth Day of June, 1992

*Attest:*

DOUGLAS B. COMER

*Attesting Officer*

*Acting Commissioner of Patents and Trademarks*